United States Patent [19]

Komotzki

[11] Patent Number: 5,029,944

[45] Date of Patent: Jul. 9, 1991

[54] DEVICE FOR RELEASABLE MOUNTING TOOLS IN MINING MACHINES

[76] Inventor: Michael Komotzki, Vöhdeweg 46, D-4607 Kamen-Heeren-Werve, Fed. Rep. of Germany

[21] Appl. No.: 585,393

[22] Filed: Sep. 20, 1990

[51] Int. Cl.[5] ..... E21C 25/12; E21C 35/18

[52] U.S. Cl. ..... 299/91; 299/92

[58] Field of Search ..... 299/79, 86, 91, 92, 299/93; 37/142 A

[56] References Cited

U.S. PATENT DOCUMENTS

| | | | |
|---|---|---|---|
| 3,865,437 | 2/1975 | Crosby | 299/86 |
| 4,744,605 | 5/1988 | Komotzki | 299/91 |

FOREIGN PATENT DOCUMENTS

| | | | |
|---|---|---|---|
| 8805961 | 4/1988 | Fed. Rep. of Germany . | |
| 1096146 | 12/1967 | United Kingdom | 299/92 |
| 8802436 | 4/1988 | World Int. Prop. O. | 299/91 |

*Primary Examiner*—David J. Bagnell

*Attorney, Agent, or Firm*—Peter K. Kontler

[57] ABSTRACT

A tool holding device for use in mining machines has a base with a plane surface which abuts a plane surface of a detachable tool holder. The latter has a through hole for a protuberance of the base and two projections which are remote from the through hole and extend into complementary recesses in the surface of the base. The protuberance of the base has a transverse aperture which is outwardly adjacent an exposed surface of the tool holder opposite the abutting surfaces and serves to receive the deformable prongs of a slidable coupling member having a head adjacent the free end of the protuberance. The shank of the material removing tool is receivable in aligned sockets of the tool holder and base in such a way that the working end of the properly inserted tool is adjacent the head of the coupling member and the bolt cannot be extracted or expelled from the aperture prior to removal of the tool shank from the sockets. This ensures that the tool holder cannot become accidentally separated from the base when the tool holding device is in actual use. When the tool holder is properly interfitted with the base, it protects the base from damage.

10 Claims, 1 Drawing Sheet

FIG.1
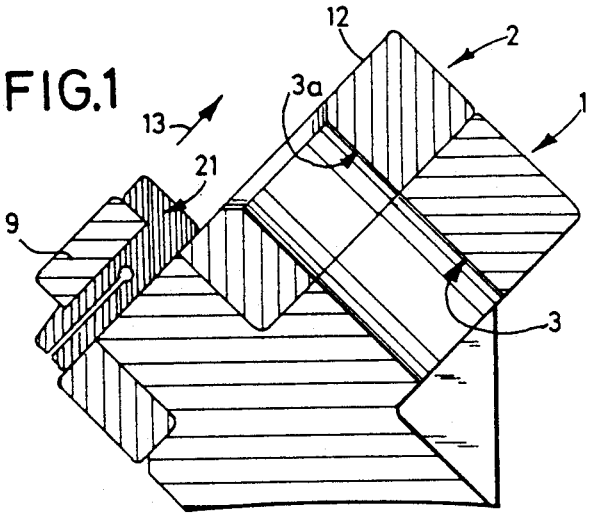
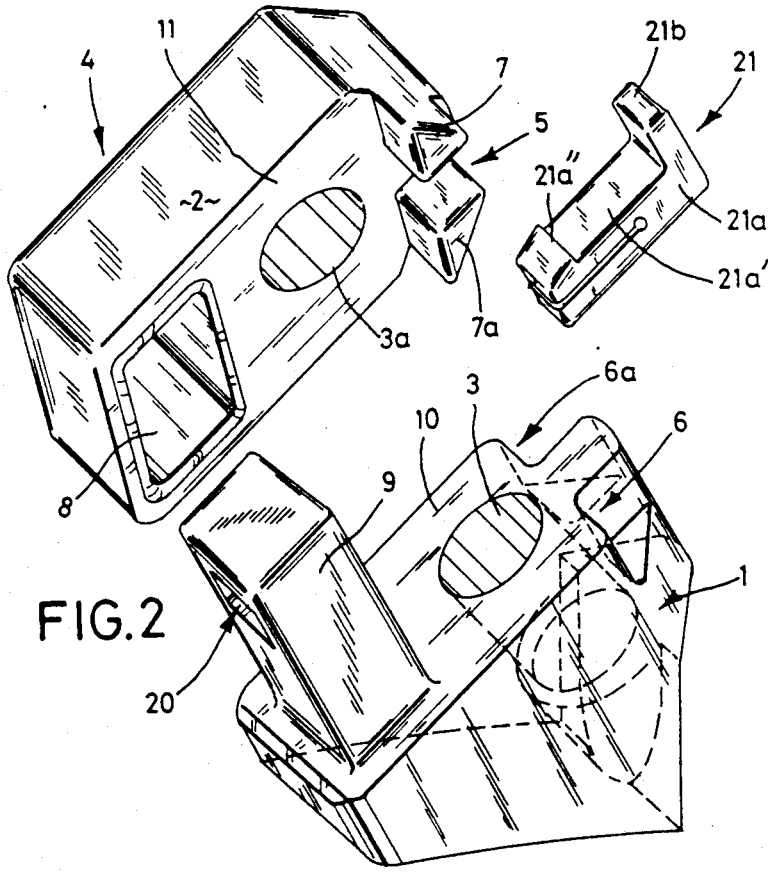
FIG.2

DEVICE FOR RELEASABLE MOUNTING TOOLS IN MINING MACHINES

BACKGROUND OF THE INVENTION

The invention relates to material removing machines, such as mining machines, and more particularly to improvements in devices for mounting or holding material removing tools (e.g., bits) in such machines.

Commonly owned German Utility Model No. G 88 05 961.8 discloses a tool mounting device having a base which is affixed to the mining machine and a tool holder which is separably interfitted with the base. The base has a tapped polygonal nut which extends into a complementary recess of the tool holder, and the latter has an opening for the shank of a screw which is driven into the nut to affix the tool holder to the base. The tool holder is provided with a collar which surrounds a through hole or bore for the shank of the material removing tool and is receivable in a recess of the base. The shank of the material removing tool is mounted only in the tool holder.

U.S. Pat. No. 3,865,437 to Crosby discloses a rotary mining tool retaining structure wherein the shank of the bit is elastic and must be deformed preparatory to insertion into the socket (namely a through bore or hole) of a tool holder. Alternatively, the pronged shank of the tool is receivable in a sleeve which, in turn has a pronged shank receivable in a through hole or bore of the tool holder.

A drawback of a pronged shank, particularly on a material removing tool for use in a mining or like machine, is that the tool is likely to become separated from its holder when the machine employing the tool is in actual use. Moreover, the tool holder of Crosby can accept only specially designed tools, namely tools with slotted shanks which can be deformed for introduction into the socket of the tool holder or into the socket of the aforementioned sleeve.

Certain other types of holders for bits and analogous material removing tools for use in mining and like machines are disclosed in commonly owned U.S. Pat. No. 4,744,605 granted May 17, 1988.

OBJECTS OF THE INVENTION

An object of the invention is to provide a tool mounting device which can be used with advantage in mining and like machines and wherein the tool can be properly secured to its holder and/or to other parts without resorting to screws or other threaded fasteners.

Another object of the invention is to provide a device wherein the base (i.e., that part which is affixed to the machine proper) is shielded by the other part or parts so that it is not likely to be damaged by the removed material and can stand long periods of use.

A further object of the invention is to provide a novel and improved base and a novel and improved tool holder for use in the above outlined tool mounting device.

An additional object of the invention is to provide a novel and improved method of interdigitating the base and the tool holder of the above outlined tool mounting device.

Still another object of the invention is to provide a device wherein the tool can be properly held for removal of material from a mine face or the like even if a portion of the tool holder is damaged or breaks away.

A further object of the invention is to provide a device wherein a damaged or destroyed tool holder can be replaced with a fresh tool holder in a time-saving operation and without the need for specially designed tools.

Another object of the invention is to provide novel and improved means for releasably coupling separable parts in the above outlined tool mounting device.

A further object of the invention is to provide a machine which embodies one or more tool mounting devices of the above outlined character.

An additional object of the invention is to provide a device wherein the shank of the tool can be reliably anchored in several separable parts.

Another object of the invention is to provide a device which can withstand pronounced forces irrespective of the direction of action of the forces and which can be used in existing mining and like machines as a superior substitute for heretofore known and used tool mounting devices

SUMMARY OF THE INVENTION

The invention is embodied in a device for releasably mounting material removing tools in mining and like machines to remove and comminute rock, coal or other minerals. The improved mounting device includes a base having a preferably plane first surface, a protuberance which extends from the first surface, at least one recess which is provided in the first surface and is preferably remote from the protuberance, and a transverse aperture which is provided in the protuberance and is spaced apart from the first surface. The mounting device further comprises a tool holder having a preferably plane second surface which abuts the first surface, at least one projection extending from the second surface and snugly received in the at least one recess, a third surface which is located opposite and can be parallel to the second surface, a tool-receiving socket in the third surface, and a through hole extending between the second and third surface and snugly receiving a portion of the protuberance in such a way that the aperture is outwardly adjacent the third surface. Still further, the mounting device comprises means for releasably coupling the tool holder to the base, and such coupling means includes a preferably slidable bolt which is received in the aperture to prevent the tool holder from moving away from the first surface and of extracting its projection or projections from the complementary recess or recesses of the base.

It is presently preferred to employ a protuberance which has a polygonal (particularly a square or rectangular) cross-sectional outline. The socket is disposed between the at least one projection and the through hole of the tool holder. The tool holder can be provided with a plurality of projections (e.g., with two similar or identical projections), and the first surface is then provided with a plurality of recesses, one for each projection and each preferably snugly receiving the respective projection. In accordance with a presently preferred embodiment, the tool holder is a substantially L-shaped part having a first leg and a second leg which latter includes or consists of the projection or projections. The second and third surfaces are provided on and the socket and the through hole are provided in the first leg of such L-shaped tool holder.

The coupling means preferably further includes an enlarged portion (hereinafter called head) which cannot enter the aperture of the protuberance and is disposed between the protuberance and the socket so that a tool which has a shank in the socket and a working or material removing portion adjacent the third surface of the tool holder prevents a movement of the head in a direction to extract or expel the bolt from the aperture. In order words, the tool holder can be uncoupled from the base only when the tool is detached from the tool holder. This prevents accidental separation of the tool holder from the base when the improved mounting device is in actual use in a mining or like machine. The aperture can extend through the entire protuberance and has an open end facing toward the socket in the third surface of the tool holder.

The bolt is or can be deformable and is then frictionally held in the aperture. For example, the bolt can be made, at least in part, of a resilient material and can include a plurality of prongs which bear against the internal surfaces of the protuberance in the aperture.

The socket can constitute a through bore which extends all the way between the second and third surfaces, and the base can be provided with a second socket (e.g., in the form of a second through bore) which is aligned with the socket of the tool holder.

The novel features which are considered as characteristic of the invention are set forth in particular in the appended claims. The improved tool mounting device itself, however, both as to its construction and the mode of assembling and using the same, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a sectional view of the assembled tool mounting device but with the material removing tool omitted; and FIG. 2 is an exploded perspective view of the improved device, with the tool holder in an orientation different from that which is shown in FIG. 1.

DESCRIPTION OF PREFERRED EMBODIMENTS

The drawing shows a tool mounting device which comprises a base 1 adapted to be installed in a mining machine which removes material from a mine face. The base 1 has a plane surface 10 which is formed with two similar or identical recesses 6, 6*a* at one end and from which extends an elongated protuberance 9 at the other end. When the tool mounting device is assembled in a manner as shown in FIG. 1, the surface 10 abuts the adjacent plane surface 11 of an elongated L-shaped tool holder 2 which has a longer leg 4 and a shorter leg 5 extending substantially at right angles to the longer leg. The shorter leg 5 consists of two identical or similar projections 7, 7*a* which are snugly received in the respective recesses 6, 6*a*. The surface 11 is provided on the leg 4 which further includes a surface 12 opposite and parallel to the surface 11, a through hole 8 which extends between the surfaces 11, 12 and snugly receives the major portion of the protuberance 9, and a tool-receiving socket 3*a* in the form of a through bore or hole extending all the way from the surface 12 to the surface 11. The illustrated base 1 has a second socket 3 in the form of a through bore or hole which is aligned with the socket 3*a* when the surface 11 abuts the surface 10, i.e., when the projections 7, 7*a* are snugly received in the respective recesses 6, 6*a* and the protuberance 9 extends through and beyond the hole 8.

The illustrated protuberance 9 has a polygonal (preferably a square or rectangular) cross-sectional outline and its major portion at least substantially fills the entire hole 8. A transversely extending aperture 20 in the form of a through hole having a rectangular cross-sectional outline is provided in the protuberance 9 and is spaced apart from the surface 10 so that it is immediately and outwardly adjacent the surface 12 when the base 1 and tool holder 2 are properly interfitted or interdigitated in a manner as shown in FIG. 1. This renders it possible to insert into the aperture 20 the deformable bolt or blade 21 of a substantially L-shaped coupling member 21 which then abuts the surface 12 at opposite ends of the aperture 20. The coupling member 21 further includes an enlarged portion or head 21*b* which is disposed between the protuberance 9 and the working end of a material removing tool (not shown) when the shank or stem of such tool is received in the sockets 3 and 3*a*. The working end of the tool is then located in the path of movement of the head 21*b* in a direction (note the arrow 13 in FIG. 1) to permit extraction or expulsion of the bolt 21*a* from the aperture 20, i.e., to permit separation of the tool holder 2 from the base 1. An advantage of such positioning of the head 21*b* (adjacent that open end of the aperture 20 which faces the adjacent end of the socket 3*a* in the surface 12) is that the tool holder 2 cannot become accidentally separated from the base 1 when the improved tool mounting device is in actual use in a mining machine or another material removing machine.

The illustrated bolt 21*a* is made of a resilient metallic material and has two prongs which undergo deformation in response to insertion into the aperture 20 so that they are in requisite frictional engagement with the internal surfaces of the protuberance 9 within the aperture 20. The upper prong 21*a*′ of the bolt 21*a* can be provided with a small tooth 21*a*″ which engages the adjacent external surface of the protuberance 9 when the bolt 21*a* is fully received in the aperture 20 so that the head 21*b* abuts the adjacent external surface of the protuberance (see FIG. 1). The prong 21*a*′ must be slightly depressed toward the other prong preparatory to extraction or expulsion of the bolt 21*a* from the aperture 20. Such extraction or expulsion can take place subsequent to extraction of the shank of the material removing tool from the aligned sockets 3*a*, 3 of the tool holder 2 and base 1. The tool can be of the type disclosed, for example, in U.S. Pat. No. 3,865,437 to Crosby or in commonly owned German Utility Model No. G 88 05 961.8.

The coupling member 21 ensures reliable retention of the tool holder 2 in engagement with the base 1 (so that the surfaces 10 and 11 abut each other) even if the one and/or the other projection 7, 7*a* wears away or is broken away when the tool mounting device is in actual use. The tool shank in the sockets 3*a*, 3 then cooperates with the coupling member 21 and with the protuberance 9 to ensure that the surfaces 10, 11 continue to abut each other and the tool can continue to remove and/or comminute ore or another material in an underground excavation or at another location where the tool mounting device is put to use.

The tool holder 2 shields the base 1 from extensive wear and/or other damage. If the tool holder 2 is damaged or destroyed, it can be rapidly detached from the base 1 and replaced with a fresh tool holder. All that is necessary is to extract the shank of the tool from the sockets 3*a*, 3 and to thereupon extract or expel the bolt 21*a* of the coupling member 21 from the aperture 20 of the protuberance 9. The base 1 is affixed to the mining machine so that a replacement of the base would involve much greater expenditures in time than mere replacement of a damaged or destroyed tool holder.

The deformable resilient bolt 21*a* of the coupling member 21 exhibits the advantage that the tool holder 2 can be reliably secured to the base 1 without the need for any externally and/or internally threaded parts. The utilization of screws and/or other threaded fasteners is often undesirable in tool mounting devices for use in mining and like machines because the stresses are often so pronounced that the threads are rapidly damaged or destroyed and the fasteners cannot be removed to permit replacement of a damaged tool holder or another part. Moreover, vibrations to which a tool mounting device for use in a mining machine is subjected are often so pronounced that a threaded fastener is likely to become loose unless it is held against loosening by specially designed locking devices which contribute to the cost of the tool mounting device and must be applied and removed in a time-consuming operation.

The feature that the deformable bolt 21*a* of the coupling member 21 is insertable into and removable from the aperture 20 of the protuberance 9 in directions at right angles to the axis of the tool shank in the sockets 3*a*, 3 exhibits the advantage that the orientation of the aperture 20 can be readily selected with a view to ensure that the properly installed tool prevents accidental extraction or expulsion of the bolt when the tool is properly installed in the tool holder 2 and base 1.

The number of projections on the tool holder 2 can be reduced to one or increased to three or more. It is presently preferred to provide the tool holder 2 with at least two projections.

The cross-sectional outline of the aperture 20 depends upon the shape of the bolt 21*a* or vice versa. The same applies for the shape of the projections 7, 7*a* and of the complementary recesses 6, 6*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for releasably mounting material removing tools in mining machines, comprising a base having a first surface, a protuberance extending from said surface, at least one recess provided in said surface, and a transverse aperture provided in said protuberance and spaced apart from said surface; a tool holder having a second surface abutting said first surface, at least one projection extending from said second surface and snugly received in said at least one recess, a third surface opposite said second surface, a tool-receiving socket provided in said third surface and a through hole extending between said second and third surfaces and receiving a portion of said protuberance, said aperture being outwardly adjacent said third surface; and means for releasably coupling said tool holder to said base, including a bolt in said aperture.

2. The device of claim 1, wherein said protuberance has a polygonal cross-sectional outline and said at least one recess is remote from said protuberance, said socket being disposed between said at least one projection and said through hole.

3. The device of claim 1, wherein said tool holder has a plurality of projections and said first surface has a plurality of recesses, one for each of said projections.

4. The device of claim 1, wherein said tool holder includes a first leg and a second leg including said at least one projection, said second and third surfaces being provided on said first leg and said hole and said socket being provided in said first leg.

5. The device of claim 1, wherein said coupling means further comprises a head which is disposed between said protuberance and said socket so that a tool which is partially received in said socket and has a portion adjacent said third surface prevents a movement of said head in a direction to extract said bolt from said aperture.

6. The device of claim 5, wherein said aperture has an open end facing toward the socket in said third surface.

7. The device of claim 1, wherein said bolt is deformable and is frictionally held in said aperture.

8. The device of claim 7, wherein said bolt is resilient and includes a plurality of prongs bearing against said protuberance in said aperture.

9. The device of claim 1, wherein said socket is a through bore which extends between said second and third surfaces.

10. The device of claim 9, wherein said first surface has a second socket in alignment with said through bore.

* * * * *